US006547682B1

(12) United States Patent
Goodwin

(10) Patent No.: US 6,547,682 B1
(45) Date of Patent: Apr. 15, 2003

(54) GOLF BALL MARKER CARRIER AND METHOD

(76) Inventor: Stephen C. Goodwin, 188 Cochituate Rd, Wayland, MA (US) 01778

( * ) Notice: Subject to any disclaimer, the term of this patent is extended or adjusted under 35 U.S.C. 154(b) by 0 days.

(21) Appl. No.: 09/655,586

(22) Filed: Sep. 6, 2000

Related U.S. Application Data

(60) Provisional application No. 60/174,546, filed on Jan. 5, 2000.

(51) Int. Cl.[7] ..... A63B 57/00
(52) U.S. Cl. ..... 473/406; 224/918
(58) Field of Search ..... 473/406; 224/918; D21/793, 794

(56) References Cited

U.S. PATENT DOCUMENTS 2,662,677 A * 12/1953 Perry ..... 224/918
3,556,364 A * 1/1971 Maretka ..... 224/918
3,674,189 A * 7/1972 Walbeck ..... 224/918
4,130,950 A * 12/1978 Bazzle et al. ..... 473/406
D265,020 S * 6/1982 Silton ..... 224/918
5,135,220 A * 8/1992 Baldoni ..... 473/406
5,423,530 A * 6/1995 Gonzalez ..... 473/406

* cited by examiner

*Primary Examiner*—Steven Wong
(74) *Attorney, Agent, or Firm*—Richard J. Birch

(57) ABSTRACT

A golf ball marker carrier has an elongated element having at least two through bores to accommodate a shoe shoelace so that the carrier can be affixed to a shoe. A golf ball marker is affixed to the elongated element in the form of a snap fastener in which the removable snap of the fastener constitutes the golf ball marker. Included is a method for affixing the golf ball marker carrier to a shoe.

17 Claims, 2 Drawing Sheets

GOLF BALL MARKER CARRIER AND METHOD

CROSS REFERENCE TO RELATED APPLICATION

The present application is a Continuation- in-Part Application of Provisional Application Ser. No. 60/174,546 filed Jun. 5, 2000 by Stephen C. Goodwin

BACKGROUND OF THE INVENTION

The present invention relates to golf ball markers, and, more particularly to a golf ball marker carrier that can be removably secured to a shoe via the shoe lace of the shoe.

Golf ball markers are employed to mark the position of a golf ball. Golfers have used coins that are in pockets containing other objects. Some golfers use a ball marker which is located on the golfer's glove which is clumsy to remove at times. Other golfers use a separate device which they have to carry in a cumbersome fashion.

It is a general object of the present invention to provide an improved golf ball marker carrier.

It is a specific object of the invention to provide a golf ball marker carrier that can be comfortably and removably attached to the wearer's shoe.

BRIEF SUMMARY OF THE INVENTION

A golf ball marker carrier has an elongated element with at least two through bores that accommodate a shoelace of the wearer's shoe to removably secure the golf ball marker to the shoe. A snap fastener is affixed the elongated element and removably contains the snap of the snap fastener. The snap constitutes the golf ball marker. Preferably the elongated element is curved to accommodate the shape of the shoe and can include extensions that fit under the upper of the shoe.

DESCRIPTION OF THE INVENTION

Figure 1:
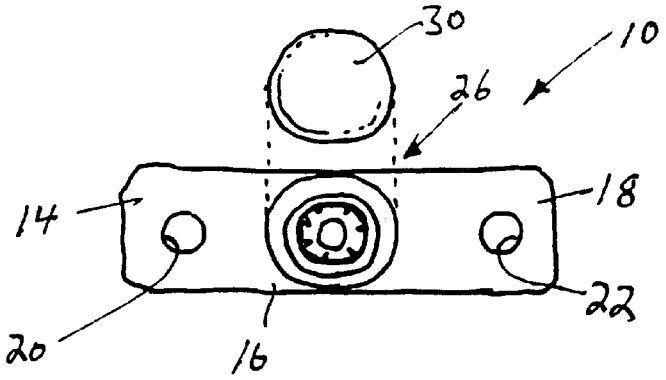
FIG. 1 is an exploded plan view of one embodiment of a golf ball marker illustrating the snap fastener with the snap removed therefrom.
Figure 2:
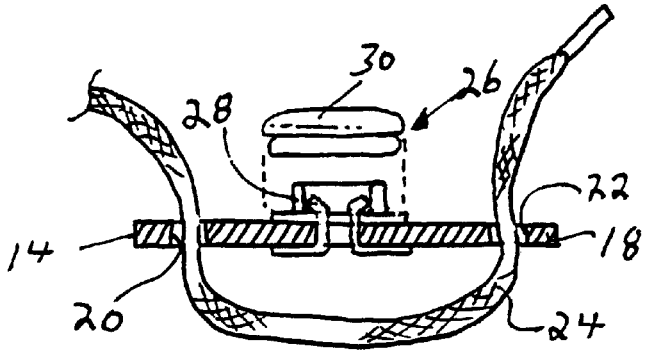
FIG. 2 is a view in side elevation and partial section showing a shoelace extending through the through bores of the carrier of FIG. 1.

Turning now to the drawings and particularly to FIGS. 1 and 2, there is shown a golf ball marker carrier indicated generally by the reference numeral 10. The carrier 10 comprises a longitudinally extending element 12 having a first end portion 14, a middle portion 16 and a second end portion 18. A through bore 20 is located in the first end portion 14 while a similar through bore 22 is located in the second end portion 18. The through bores 20 and 22 accommodate a shoelace 24 of the wearer's shoe (not shown) so that the gold ball marker carrier can be removably secured to the shoe.

A snap fastener, indicated generally by the reference numeral 26, comprises a marker receptacle 28 and a snap fastener 30 removably held therein.

Figure 3:
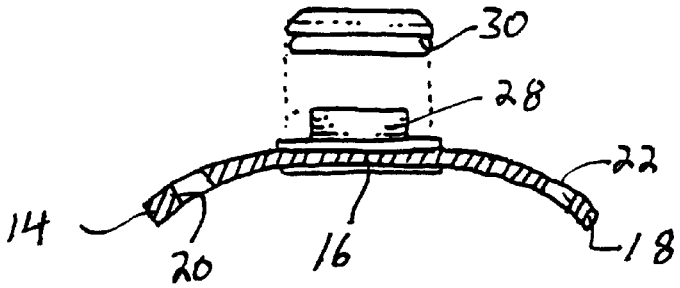
FIG. 3 is a view in side elevation an partial section illustrating a curved golf ball marker carrier.
Figure 4:
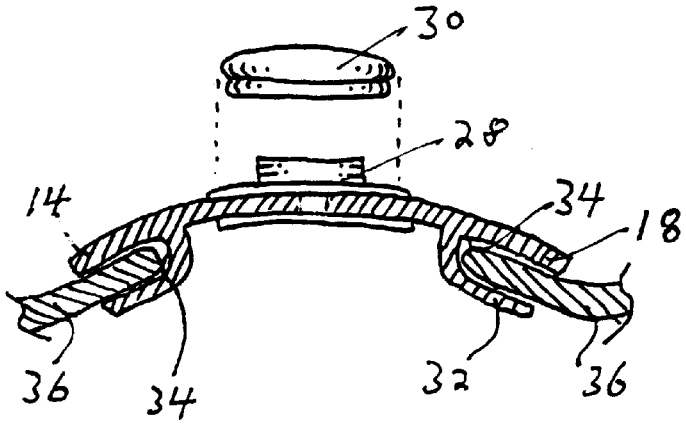
FIG. 4 is another view in side elevation and partial section depicting the golf ball carrier with extensions that provide a pocket for the shoe's upper.

The element 12 can be formed from a variety of materials including plastic and aluminum and can be straight (FIGS. 1 and 2) or preferably curved as illustrated in FIGS. 3 and 4. The element 12 can be relatively flexible. FIG. 4 depicts another embodiment of the invention in which the element 12 has two shoe upper extensions 32 that define shoe upper pockets 34 that receive shoe upper portions 36 therein.

Figure 5:
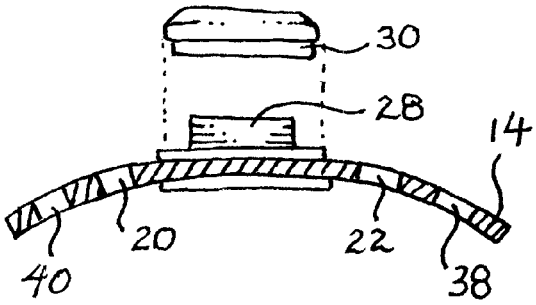
FIG. 5 is another view in side elevation similar to FIG. 3, but illustrating another embodiment of the invention in which four through bores are provided for the shoelace; and, FIG. 6 is a diagrammatic illustration showing the preferred lacing sequence for the embodiment depicted in FIG. 5.
Figure 6:
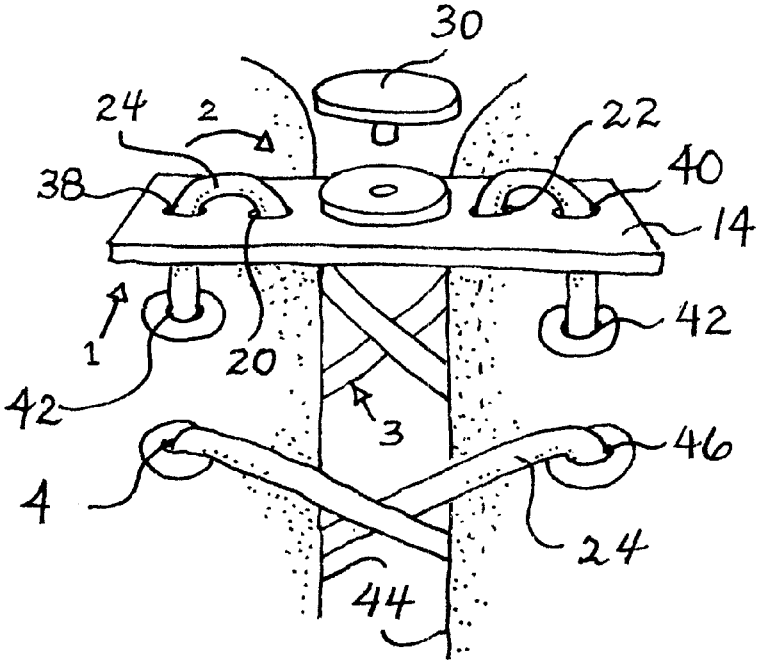

FIG. 5 depicts another embodiment of the invention in which through bores 20 and 22, as shown in FIG. 3, are complemented by additional through bores 38 and 40 to provide four shoelace apertures that can be laced as depicted in FIG. 6.

Referring to FIG. 6, the sequence of lacing the golf ball marker carrier to a shoe is illustrated with the steps being numbered 1 through 3 as follows:

Step 1—lace under the front two eyelets 42 of the shoe 44 and even out the lace.

Step 2—pull the lace up through the outside carrier bores 38 and 40 and down through the inside bores 20 and 22. Pull the lace snug.

Step 3—cross lace and pull through the second pair of shoe eyelets 46 and continue in the normal shoe lacing sequence.

It should be noted that the carrier 14 shown in FIG. 6 is depicted in flat form only for purposes of clarity of illustration. However, the preferred shape is curved as shown in FIGS. 3 and 5 and that the carrier can be constructed from metal as well as plastic and other functionally equivalent materials.

Having described preferred embodiments of my invention, it will now be apparent to those skilled in the art that numerous modifications can be made therein without departing from the scope of the invention as defined in the following claims:

What I claim is:

1. A golf ball marker carrier comprising:

a longitudinally extending element having a longitudinal axis, a first end portion, a middle portion and a second end portion with at least one bore extending through said first end portion and with at least one bore extending through said second end portion, said bores being positioned substantially along said longitudinal axis and being of sufficient dimension to accommodate a shoelace passing there through; and, a golf ball marker receptacle secured to said middle portion substantially along said longitudinal axis whereby said carrier can be retained on a shoelace of a shoe with a golf ball marker releasably held in said receptacle.

2. The golf ball marker carrier of claim 1 wherein said longitudinally extending element is formed of plastic.

3. The golf ball marker carrier of claim 2 wherein said plastic is relatively flexible.

4. The golf ball marker carrier of claim 1 wherein said longitudinally extending element is formed of a metal.

5. The golf ball marker carrier of claim 4 wherein said metal is aluminum.

6. The golf ball marker of claim 1 wherein said longitudinally extending element is curved with top and bottom surfaces and further comprising a first shoe upper portion engaging extension on the bottom surface of said first end portion and a second shoe upper portion engaging extension on the bottom surface of the second end portion whereby a first and a second shoe upper portion are positioned between the respective first and second bottom surfaces and the respective extensions when the golf ball marker carrier is secured by a shoelace on a shoe.

7. A golf ball marker carrier comprising:

a longitudinally extending element having a longitudinal axis, a first end portion, a middle portion and a second end portion with an innermost and an outermost bore extending through said first end portion and with an innermost and an outermost bore extending through said second end portion, said bores being positioned substantially along said longitudinal axis and being of sufficient dimension to accommodate a shoelace passing there through; and, a snap fastener golf ball marker receptacle secured to said middle portion substantially along said longitudinal axis whereby said carrier can be retained on a shoelace of a shoe with a snap of the snap fastener releasably held in said receptacle and constituting a golf ball marker.

8. The golf ball marker carrier of claim 7 wherein said longitudinally extending element is formed of plastic.

9. The golf ball marker carrier of claim 8 wherein said plastic is relatively flexible.

10. The golf ball marker carrier of claim 7 wherein said longitudinally extending element is formed of metal.

11. The golf ball marker carrier of claim 10 wherein said metal is aluminum.

12. The golf ball marker of claim 7 wherein said longitudinally extending element is substantially planar with top and bottom surfaces and further comprising a first shoe upper portion engaging extension on the bottom surface of said first end portion and a second shoe upper portion engaging extension on the bottom surface of the second end portion whereby a first and a second shoe upper portion are positioned between the respective first and second bottom surfaces and the respective extensions when the golf ball marker carrier is secured by a shoelace on a shoe.

13. The golf ball marker carrier of claim 12 wherein said longitudinally extending element is formed of plastic.

14. The golf ball marker carrier of claim 12 wherein said plastic is relatively flexible.

15. The golf ball marker carrier of claim 12 wherein said longitudinally extending element is formed of metal.

16. The golf ball marker carrier of claim 12 wherein said metal is aluminum.

17. A method for affixing the golf ball marker carrier of claim 7 to a shoe comprising the steps of:

a) evenly positioning a shoelace under front eyelets of a shoe;

b) pulling the shoelace up through each of the outmost bores in said first and second end portions and then down through the innermost bores in said first and second end portions until the shoelace is snug; and, c) cross lacing the shoe lace through subsequent eyelets of the shoe.

* * * * *